US010694803B2

(12) United States Patent
Neal

(10) Patent No.: US 10,694,803 B2
(45) Date of Patent: Jun. 30, 2020

(54) SHOCK ABSORPTIVE FACE MASK

(71) Applicant: Cincyguys, LLC, Liberty Township, OH (US)

(72) Inventor: Braxton Neal, Cincinati, OH (US)

(73) Assignee: Cincyguys, LLC, Liberty Township, OH (US)

( * ) Notice: Subject to any disclaimer, the term of this patent is extended or adjusted under 35 U.S.C. 154(b) by 96 days.

(21) Appl. No.: 15/824,197

(22) Filed: Nov. 28, 2017

(65) Prior Publication Data

US 2018/0206583 A1 Jul. 26, 2018

(51) Int. Cl.
*A63B 71/10* (2006.01)
*A42B 3/20* (2006.01)

(52) U.S. Cl.
CPC ..... *A42B 3/20* (2013.01); *A63B 71/10* (2013.01)

(58) Field of Classification Search
CPC ..... A42B 3/20
See application file for complete search history.

(56) References Cited

U.S. PATENT DOCUMENTS 3,900,897 A 8/1975 Dunning
4,136,403 A * 1/1979 Walther ..... A62B 18/084 2/10
4,837,866 A 6/1989 Rector et al.
5,537,687 A 7/1996 Garza
5,956,777 A * 9/1999 Popovich ..... A42B 3/20 2/412
6,934,971 B2 8/2005 Ide et al.
7,036,151 B2 5/2006 Ide et al.
7,607,179 B2 10/2009 Shih
8,209,784 B2 * 7/2012 Nimmons ..... A42B 3/20 2/411
9,474,316 B2 10/2016 Berry
9,474,317 B2 10/2016 Berry
9,648,920 B1 5/2017 Kuntz
9,687,037 B1 6/2017 Colello et al.
9,750,298 B2 9/2017 Summerville
9,949,523 B2 * 4/2018 Klein ..... A42B 3/20
10,092,057 B2 * 10/2018 Kovarik ..... A42B 3/20
10,188,168 B2 * 1/2019 Tubbs ..... A42B 3/20
10,244,809 B2 * 4/2019 Linares ..... A42B 3/064
2008/0163410 A1 * 7/2008 Udelhofen ..... A42B 3/20 2/413
2008/0313791 A1 12/2008 Nagely
2009/0106882 A1 4/2009 Nimmons et al.
2011/0061152 A1 3/2011 Wismann
2011/0209272 A1 9/2011 Drake
2012/0255096 A1 10/2012 Wesley
2013/0212783 A1 8/2013 Bonin et al.
(Continued)

FOREIGN PATENT DOCUMENTS

WO 2017040427 A1 3/2017
WO 2017074206 A1 5/2017

*Primary Examiner* — Richale L Quinn
(74) *Attorney, Agent, or Firm* — Richard A. Baker, Jr.

(57) ABSTRACT

A unique attachment mechanism to connect a facemask to a helmet is described. This attachment mechanism uses a polymer urethane visco-elastic, or similar, material to absorb impact forces on the facemask to minimize injury for the person using the helmet. In some embodiments, a spring and bearing mechanism is used in conjunction with the polymer urethane visco-elastic material to further absorb forces.

16 Claims, 4 Drawing Sheets

(56) References Cited

U.S. PATENT DOCUMENTS

| | | | | |
|---|---|---|---|---|
| 2014/0101829 | A1 | 4/2014 | Witcher | |
| 2014/0201889 | A1 | 7/2014 | Pietrzak et al. | |
| 2014/0310857 | A1 | 10/2014 | Lastik et al. | |
| 2015/0201695 | A1* | 7/2015 | Shih | A63B 71/10 2/9 |
| 2015/0305431 | A1* | 10/2015 | Rush | A42B 3/20 2/411 |
| 2016/0029733 | A1 | 2/2016 | Kovarik et al. | |
| 2018/0125141 | A1 | 5/2018 | Summerville | |
| 2019/0282777 | A1* | 9/2019 | Kwok | A61M 16/0633 |

* cited by examiner

SHOCK ABSORPTIVE FACE MASK

BACKGROUND

Related Applications

None.

Technical Field

The devices described herein are directed to helmets, and more specifically to mounting mechanisms for attaching facemasks to the helmet.

Description of the Related Art

Worldwide, contact sports are popular among the populations, drawing millions of participants and hundreds of millions of speculators. In the United States, American football is revered. In Canada and northern USA, hockey is a passion. Camogie, hurling, cricket, lacrosse and baseball also have contact elements. But as full contact sports became more popular, the force of the impact between players became greater. And the number of injuries from contact increased. Players responded to the injuries by using pads, helmets and other gear to reduce the number and severity of the injuries.

In recent years, there has been a focus on chronic traumatic encephalopathy (CTE). CTE is a neurodegenerative disease found in people who have had multiple head injuries. It is most commonly found in those who have participated in contact sports on a regular basis.

Sport helmets first started as leather caps in the late 1800s, and extended into hardened leather. 1917 marked the first time helmets were raised above the head in an attempt to direct blows away from the top of the head. Ear flaps also had their downfall during this period as they had little ventilation and made it difficult for players to hear. The 1920s marked the first time that helmets were widely used in the sport of football. These helmets were made of leather and had some padding on the inside, but the padding was insufficient and provided little protection. In addition, they lacked face masks. As a result, injuries were very common. Early helmets also absorbed a lot of heat, making them very uncomfortable to wear.

In 1939, the Riddell Company of Chicago, Ill. started manufacturing plastic helmets because it felt that plastic helmets would be safer than those made of leather. Plastic was found to be more effective because it held its shape when full collision contact occurred on a play. These helmets were also much more comfortable and had more padding to cushion the head in an impact. Included with the plastic helmet came plastic face masks, which allowed the helmet to protect the entire head. By the mid-1940s, helmets were required in the National Football League ("NFL"). They were still made of leather, but with improved manufacturing techniques had assumed their more familiar spherical shape. The NFL initially allowed either plastic or leather helmets, but in 1948 the league outlawed the plastic helmet, considering the hard-plastic material to be an injury risk. The NFL repealed this rule in 1949, and by 1950, the plastic helmet had become universal in that league.

By the 1950s, the introduction of polymers ended the leather helmet era. The last leather helmet manufacturer, MacGregor, ceased production of leather helmets in the mid-1960s. The NFL also recommended face masks for players in 1955, reducing the number of broken noses and teeth.

Since the 1950s, helmets have moved into other sports, such as catcher's masks and batter helmets in baseball, hockey, camogie, hurling, cricket, and lacrosse. Helmet technology is also used in motorcycle helmets, police riot gear, firemen's helmets, and military gear.

In addition, the technology used for helmets has been further refined, with enhanced shapes and materials on the helmet itself. The facemasks initially started as plastic bars that evolved into steel with rubber or plastic coatings. Facemasks were traditionally held onto the helmet with snaps or connectors. Some helmets permanently riveted the face mask to the helmet. Some recent developments used springs to connect the mask with the helmet.

However, these attachment schemes transfer significant amount of force from the face mask to the player's helmet, resulting in either neck injuries from the rapid movement of the players head in a collision, or head/brain injuries as the force is absorbed by the head. The spring connection starts to address this problem, but suffers from the abilities of a spring to absorb all of the force. A better attachment scheme between the helmet and the facemask is required to reduce the force transmitted from the facemask to the helmet.

With the recent focus on CTE injuries, there is a strong need to find better materials and structures for helmets to reduce the number and severity of injuries in contact sports.

The present invention, eliminates the issues articulated above as well as other issues with the currently known products.

SUMMARY OF THE INVENTION

An apparatus to connect a facemask to a helmet is described herein, the apparatus comprising a helmet and a facemask attached to the helmet with an attachment mechanism where the attachment mechanism includes a polymer urethane visco-elastic material. In some embodiments the attachment mechanism includes a spring or a bearing rail or both.

In some embodiments, the helmet is an American football helmet or a hockey helmet or a lacrosse helmet or a baseball helmet or a motorcycle helmet. Or the helmet could be any other type of head protection device.

A method for manufacturing an apparatus for protecting a human head that comprises building a helmet, attaching a facemask to the helmet with an attachment mechanism, and including a polymer urethane visco-elastic material in the attachment mechanism. In some embodiments the attachment mechanism also includes a spring or a bearing rail or both.

In some embodiments, the helmet is an American football helmet or a hockey helmet or a lacrosse helmet or a baseball helmet or a motorcycle helmet. Or the helmet could be any other type of head protection device.

BRIEF DESCRIPTION OF FIGURES

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE INVENTION

In one aspect of the invention provides an attachment mechanism between a helmet and a facemask that provides for the absorption of impact forces so as to minimize injury to user of the helmet. There are many types of helmets, and the inventions described herein could be used on any of these, and other helmets. In the following embodiment, the description focuses on an American football helmet as an example, but the inventions could also be used on helmets for hockey, camogie, hurling, cricket, lacrosse and baseball, as well as other sports. The inventions could also be used on motorcycle, motocross, bicycle, ATV, snowmobile, automobile race, aviation, military, police, fire and other helmets.

Figure 1:
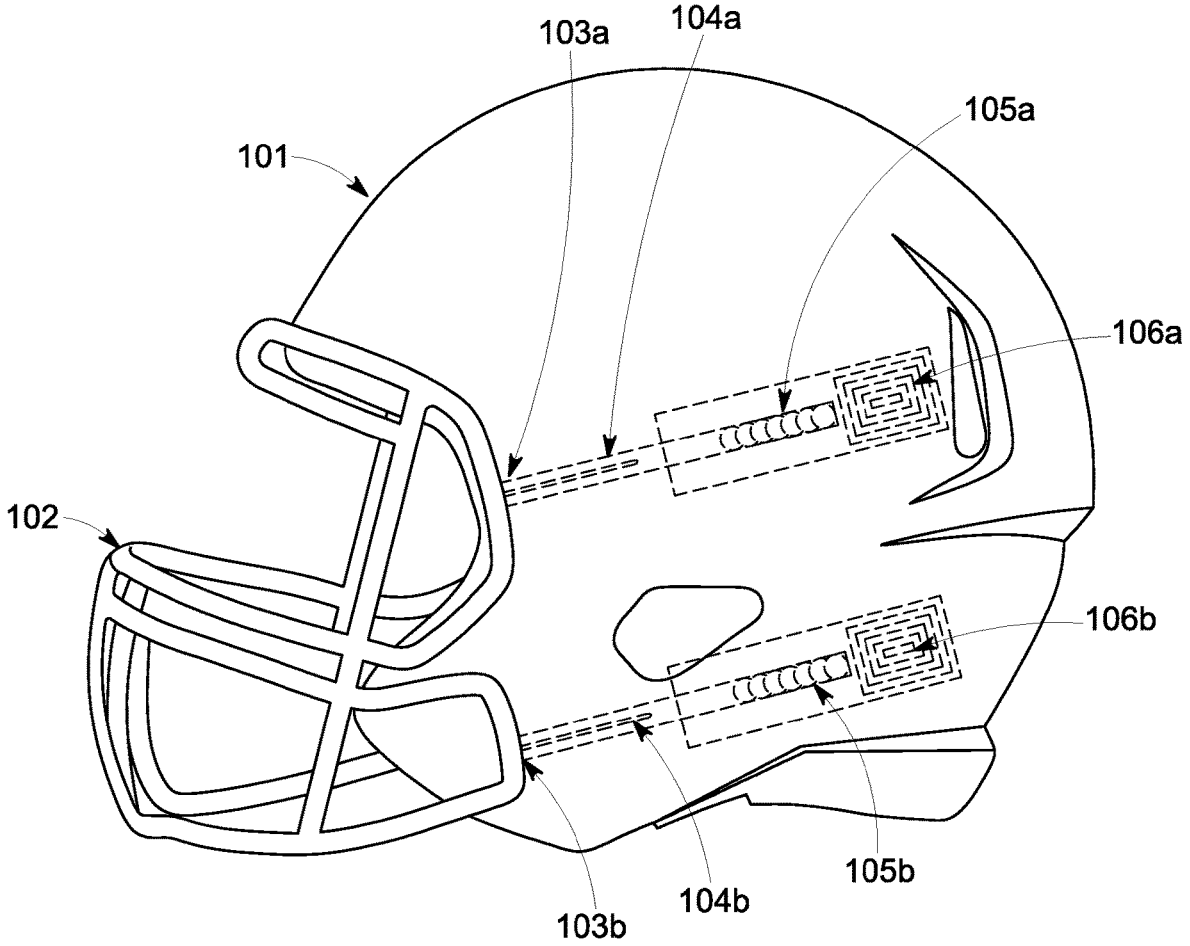
FIG. 1 is an image of a football helmet with the shock absorption facemask attachment.

As an example, see the American football helmet in FIG. 1. The helmet 101 is made of a hard plastic (ABS, polycarbonate, etc.) shell with thick padding on the inside. Other embodiments have the helmet made of leather, metals, or other materials. The helmet 101 has as facemask 102. The facemask 102 is made of polycarbonate, cellulose acetate, metal, or other materials. The facemask 102 is attached to the helmet 101 with four mask attachments 103*a*, 103*b* (only two attachments are shown in the drawing, the other two are on the opposite side of the helmet 101). The four mask attachments 103*a*, 103*b* are connected to the face mask 102 either as part of the molding of the facemask, welded to the mask, or attached to the facemask with rivets or screws. The attachments could be attached to the exterior or interior of the helmet. In another embodiment, the some of the attachments could be inside of the helmet while other are mounted to the outside. The four mask attachments 103*a*, 103*b* slide into the four bearing rails 104*a*, 104*b* and are held in place with a ball bearing. At the end of the four bearing rails 104*a*, 104*b* opposite the facemask 102, the bearing rails 104*a*, 104*b* are mechanically connected to a spring 105*a*, 105*b*. The springs 105*a*, 105*b* are then connected to a polymer urethane visco-elastic material such as Sobathane 106*a*, 106*b*. The Sobathane material 106*a*, 106*b* is glued to the side of the helmet 101. While four attachments are shown in this embodiment, the number of attachments could be varied without deviating from this invention.

Figure 2:
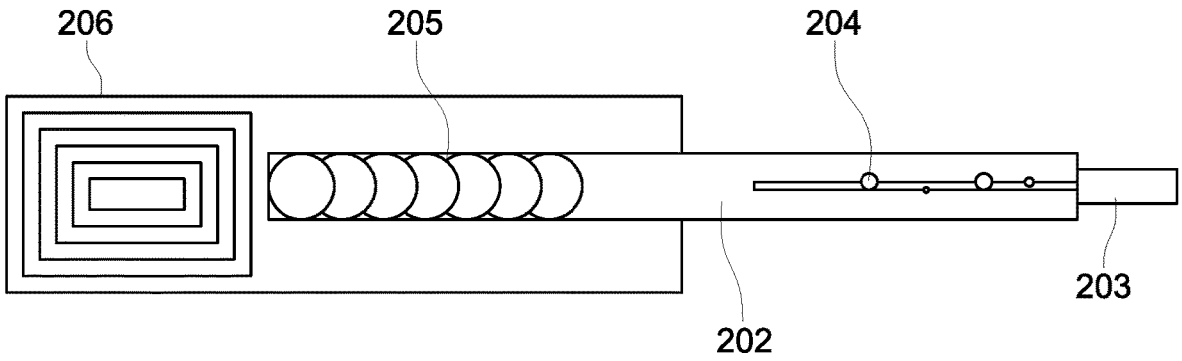
FIG. 2 is a drawing of the facemask attachment.

Looking to FIG. 2, the attachment mechanism, in one embodiment, uses a polymer urethane visco-elastic material 206, 106*a*, 106*b* such as Sorbathane to absorb the impact. Sobathane is described in a series of patents awarded to Dr. Maurice Hiles, including U.S. Pat. Nos. 4,101,704, 4,346,205, 4,476,258, and 4,808,469, each of these patents incorporated herein by reference. In other embodiments, the Sorbathane could be replaced with Silicone, Neoprene, Norsorex, Rubber, Deflex, Gel-mec, Microsorb, Memory foam, Acoustic foam, or other similar material.

In another embodiment, a compression spring (helical, conical, or volute) 205, 105*a*, 105*b* is used to absorb the shock of an impact on the facemask. In other embodiments, an extension spring or a torsion spring could be used.

In another embodiment, a ball lock mechanism on a telescoping rail could be used to absorb the shock of the impact on the facemask. See U.S. Pat. No. 4,662,771A by Elverton Row and Charles Moore for a description of a telescoping mechanism with a ball lock mechanism, said patent incorporated herein by reference.

In still another embodiment, any combination of the ball lock mechanism 202, 203, 204, the spring 205 and the polymer urethane visco-elastic material 206 (or other shock absorptive material) could be used.

Figure 4:
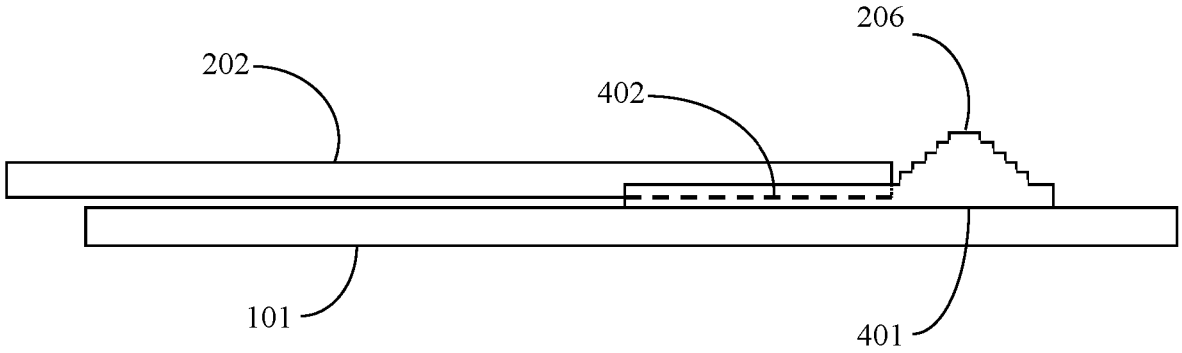
FIG. 4 is a side drawing of the facemask attachment showing the attachment on the outside of the helmet.

In the preferred embodiment, as seen in FIG. 2 and FIG. 4, the facemask 102 is attached to the face mask attachment 203. The facemask attachment 203 slides in a tube or rail 202, and is locked into place with a ball bearing 204. The attachment 203 and the tube or rail 202 are made of steel, rugged plastic, aluminum, or similar rugged material. The ball beating is typically made of steel, although any other suitable material could be used (hard plastic, aluminum, etc.). In some embodiments, the ball bearing is supported with a spring that pushes the bearing into a slot in the attachment, similar to the ball locking mechanism in a socket set. In other embodiments, the bearing (or the tube or rail) deforms to allow movement of the attachment 203 and the tube or rail 202 when sufficient force is applied.

The tube or rail 202 is mechanically attached to a spring 205. The attachment could be through welding, screws, rivets, or similar. In the preferred embodiment, the spring 205 is made of steel, stainless steel, bronze, copper or other material. In some embodiments, the spring 205 is enclosed in soft plastic, cloth, hard plastic, or similar material.

The spring 205 is mechanically attached to the polymer urethane visco-elastic material 206 (Sorbathane or other shock absorptive material). This mechanical attachment could be with an adhesive 402 such as a solvent based one-part polyurethane adhesive (such as Lord Corporation 7650) or a two-part polyurethane adhesive (Lord Corporation 7542A/B). Alternatively, Neoprene-based adhesives or cyanoacrylates (Crazy Glues or Super Glues) could be used. In some embodiments, the end of the spring 205 is bent into a "T" or an "L", with the top or bottom of the "T" or "L" molded into the polymer urethane visco-elastic material 206 in order to spread the force over a wider section of the polymer urethane visco-elastic material.

The polymer urethane visco-elastic material 206 is attached to the helmet 101 with an adhesive 401, such as a one- or two-part polyurethane, a Neoprene or a cyanoacrylate adhesive. In some embodiments, the surface of the helmet 101 could include molded posts or holes to provide additional mechanical support for the polymer urethane visco-elastic material to hold onto the helmet. The polymer urethane visco-elastic material will absorb the majority of the initial impact.

Figure 3:
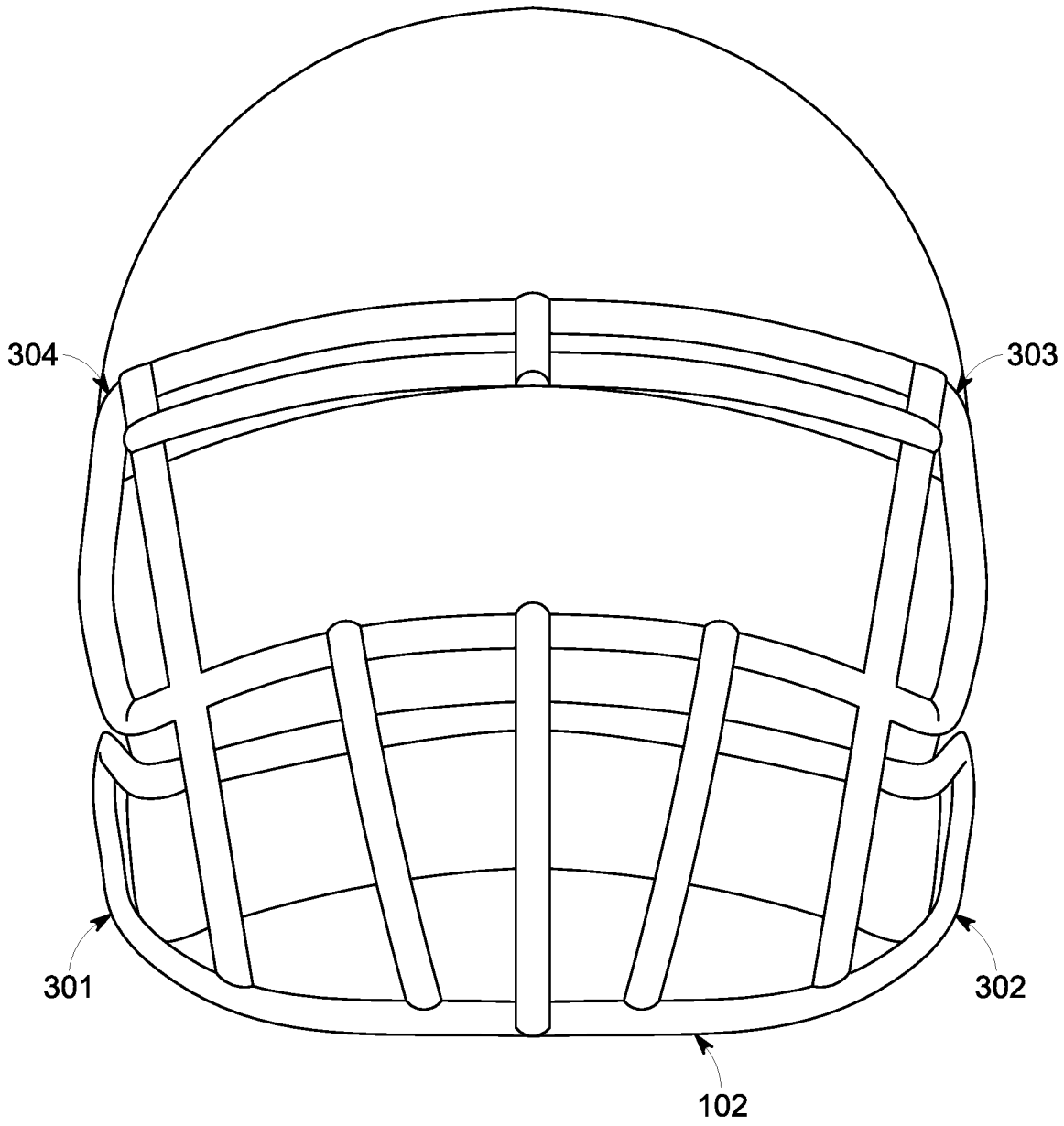
FIG. 3 is a drawing of a facemask with the attachment points.

In FIG. 3 a front view of the facemask 102 is shown. The four connecting spots 301, 301, 303, 304 are seen at the corners of the mask 102. Each of the four connecting spots 301, 302, 303, 304 have attachment mechanisms, the attachment mechanisms combining polymer urethane visco-elastic material with springs and the telescoping ball lock mechanism to provide maximum impact absorption.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. An apparatus to connect a facemask to a helmet, comprising:

the helmet;

the facemask mechanically attached to the helmet with an attachment mechanism, wherein said attachment mechanism includes a steel, plastic, or aluminum rail;

wherein the attachment mechanism for connecting the facemask to the helmet includes a polymer urethane visco-elastic material attached to the helmet outside of a side of a shell of the helmet with a polyurethane adhesive;

where the rail is attached to the facemask at a distal end and to the polymer urethane visco-elastic material at a proximal end, wherein the rail is a bearing rail attached to the facemask at one end and a spring attached to the polymer urethane visco-elastic material at another end, where the rail and the spring are mechanically connected.

2. The apparatus of claim 1 wherein the helmet is an American football helmet.

3. The apparatus of claim 1 wherein the helmet is a hockey helmet.

4. The apparatus of claim 1 wherein the helmet is a lacrosse helmet.

5. The apparatus of claim 1 wherein the helmet is a baseball helmet.

6. The apparatus of claim 1 wherein the helmet is a motorcycle helmet.

7. The apparatus of claim 1 wherein the attachment mechanism further includes a spring.

8. The apparatus of claim 1 wherein the rail is a bearing rail.

9. A method for manufacturing an apparatus for protecting a human head comprising:

building a helmet;

attaching a facemask to the helmet with an attachment mechanism, wherein said attachment mechanism includes a steel, plastic, or aluminum rail;

including a polymer urethane visco-elastic material in the attachment mechanism, wherein the polymer urethane visco-elastic material is attached to the helmet outside of a side of a shell of the helmet with a polyurethane adhesive; and attaching the rail to the facemask at a distal end and to the polymer urethane visco-elastic material at a proximal end, wherein the rail is a bearing rail attached to the facemask at one end and a spring attached to the polymer urethane visco-elastic material at another end, where the rail and the spring are mechanically connected.

10. The method of claim 9 wherein the helmet is an American football helmet.

11. The method of claim 9 wherein the helmet is a hockey helmet.

12. The method of claim 9 wherein the helmet is a lacrosse helmet.

13. The method of claim 9 wherein the helmet is a baseball helmet.

14. The method of claim 9 wherein the helmet is a motorcycle helmet.

15. The method of claim 9 including a spring in the attachment mechanism.

16. The method of claim 9 wherein the rail is a bearing rail.

* * * * *